United States Patent [19]

Trent

[11] Patent Number: 4,460,329

[45] Date of Patent: Jul. 17, 1984

[54] POWER VENT AND CONTROL FOR FURNACE

[75] Inventor: Bryan O. Trent, Smyrna, Tenn.

[73] Assignee: Heil-Quaker Corporation, Lewisburg, Tenn.

[21] Appl. No.: 338,664

[22] Filed: Jan. 11, 1982

Related U.S. Application Data

[63] Continuation-in-part of Ser. No. 116,021, Jan. 23, 1980, abandoned.

[51] Int. Cl.[3] ..... F23N 3/00

[52] U.S. Cl. ..... 431/20; 431/31; 126/116 A

[58] Field of Search ..... 431/20, 31; 126/110 R, 126/110 C, 110 E, 116 A

[56] References Cited

U.S. PATENT DOCUMENTS

| | | | |
|---|---|---|---|
| 1,713,442 | 5/1929 | Matcouich . | |
| 1,892,188 | 12/1932 | Goodridge . | |
| 2,169,077 | 8/1939 | Turner . | |
| 2,174,710 | 10/1939 | Wagner | 236/44 |
| 2,217,518 | 10/1940 | Merkt | 431/20 |
| 2,225,237 | 12/1940 | Shaw . | |
| 2,246,566 | 6/1941 | Ames et al. | 431/20 |
| 3,245,456 | 4/1966 | Cox | 431/31 |
| 3,277,947 | 10/1966 | Gacioch . | |
| 3,280,774 | 10/1966 | English | 110/162 |
| 3,403,962 | 10/1968 | Suffron et al. | 431/20 |
| 3,589,846 | 6/1971 | Place et al. | 431/31 |
| 3,650,262 | 3/1972 | Root et al. | 431/20 |
| 4,003,046 | 1/1977 | Jordan | 340/271 |
| 4,090,181 | 5/1978 | Ansari et al. | 340/271 |
| 4,251,025 | 2/1981 | Bonne et al. | 236/14 |
| 4,340,355 | 7/1982 | Nelson et al. | 431/20 |

*Primary Examiner*—Carroll B. Dority, Jr.
*Attorney, Agent, or Firm*—Wood, Dalton, Phillips, Mason & Rowe

[57] ABSTRACT

An improved power vent and associated control system for a heating apparatus such as a furnace. The invention utilizes a vent blower and a flow control orifice device permitting the use of a single size air moving device and motor with different size furnaces. The control is arranged to discontinue delivery of fuel to the furnace in the event of a blockage of the furnace flue or a failure of the air moving structure. In one form of the invention, a pressure condition is sensed downstream of the air moving structure to detect the failure conditions. In another form of the invention, the control utilizes structure to sense the speed of the air moving device. The invention comprehends the use of a motor for driving the air moving device which varies in speed substantially between the unloaded and loaded conditions. The air moving device preferably unloads under high discharge pressure conditions, such as by a blocked flue. In a preferred form of the invention, a closure closes the orifice during periods when the vent blower is not operating. The closure is responsive to fluid movement through the orifice to move automatically to an open condition.

13 Claims, 11 Drawing Figures

Fig. 1.
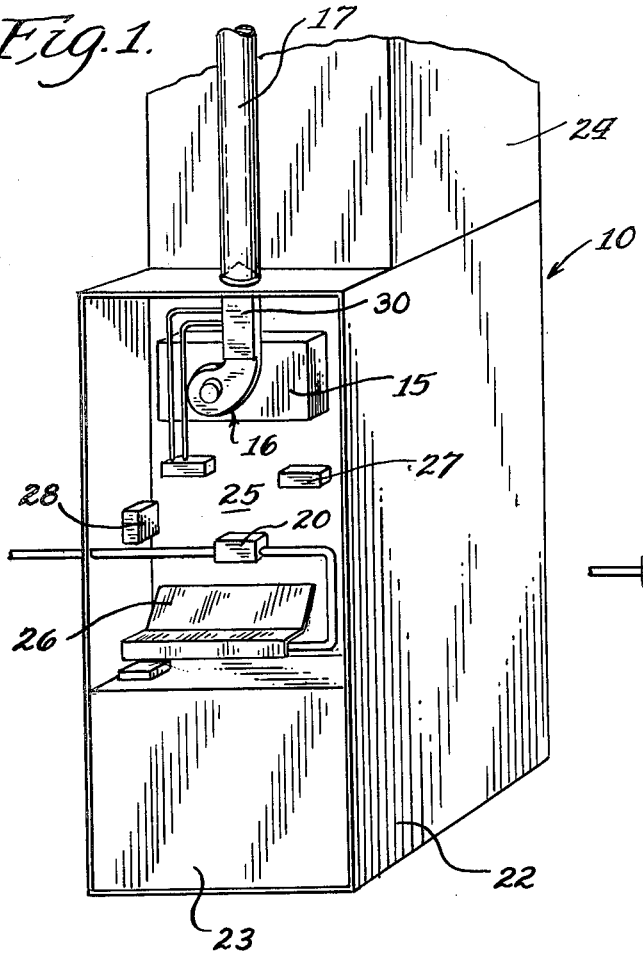
Fig. 2.
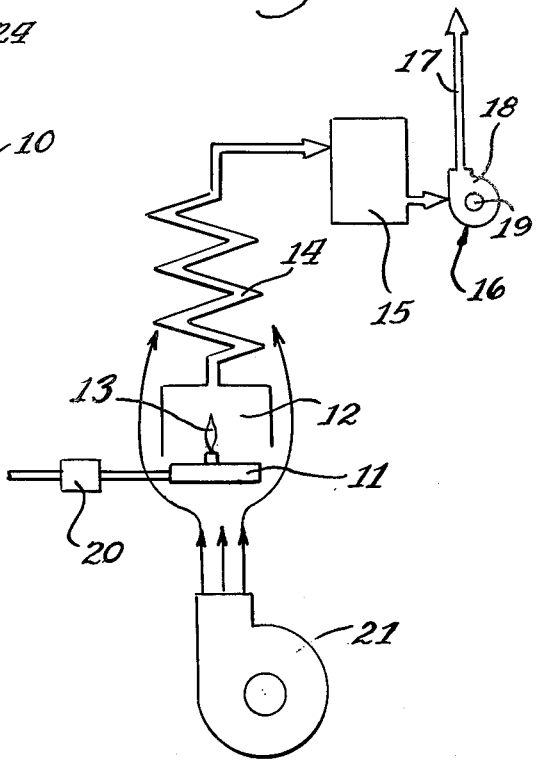
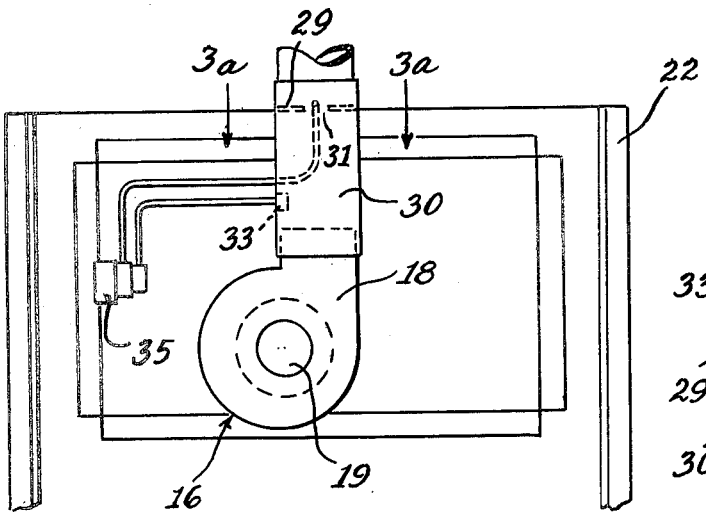
Fig. 3.
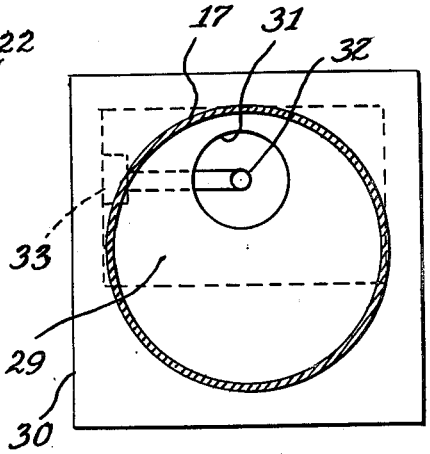
Fig. 3a.

FIG. 7
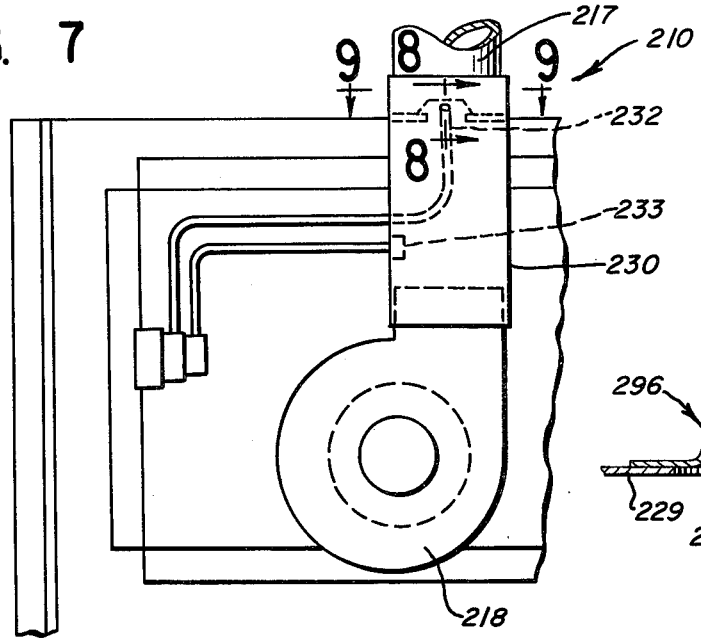
FIG. 8
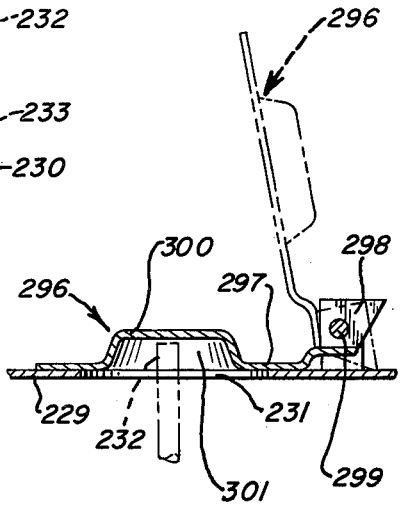
FIG. 9
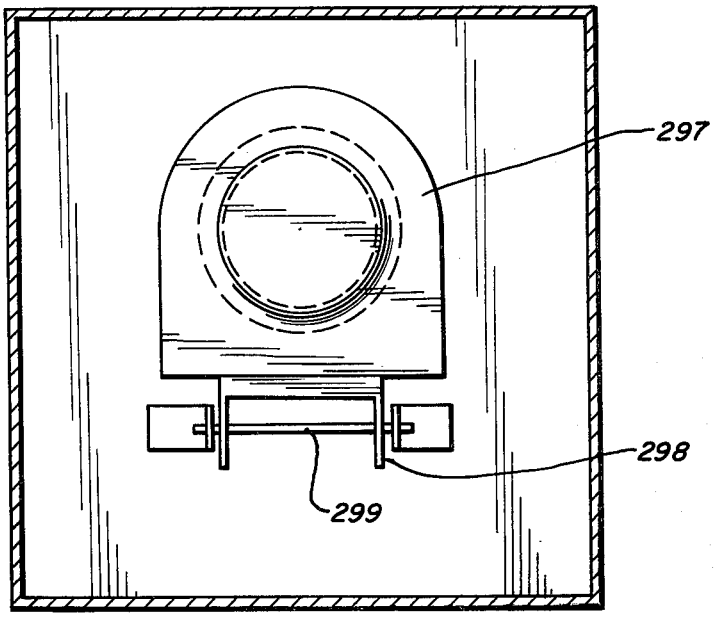
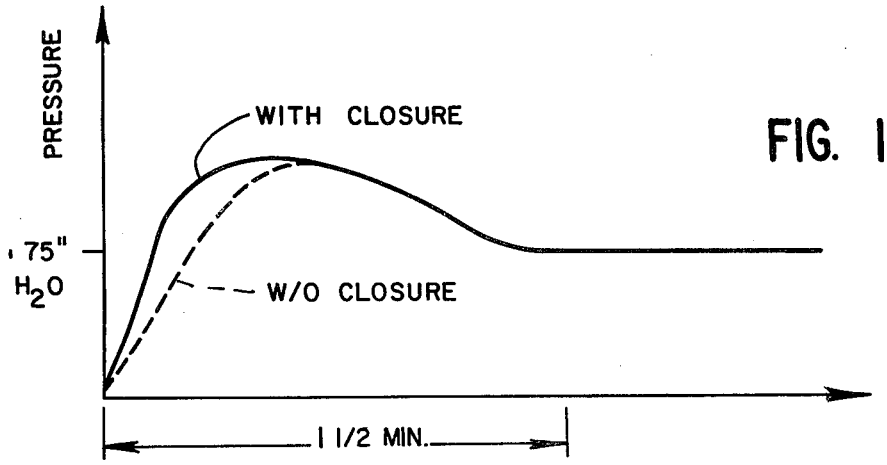
FIG. 10

POWER VENT AND CONTROL FOR FURNACE

CROSS-REFERENCE TO RELATED APPLICATION

This application comprises a continuation-in-part of my copending application Ser. No. 116,021, filed Jan. 23, 1980, entitled "Power Vent and Control for Furnace", now abandoned.

BACKGROUND OF THE INVENTION

1. Field of the Invention

This invention relates to heating means, such as furnaces, and in particular to a power vent system and control suitable for use in domestic furnaces.

2. Description of the Prior Art

In one form of heating device, such as a furnace, oven, drier, or the like, means have been provided for forcibly exhausting the products of combustion from the combustion chamber. In the event of a failure of the exhausting means to provide the desired discharge, it has been conventional to provide control means for preventing further delivery of fuel to the combustion chamber. It has further been known to provide, in such a control, means for preventing delivery of the fuel to the combustion chamber until such time as at least a minimum exhaust functioning has been established.

It has further been conventional in the prior art furnace controls to provide a flow limiting orifice in the exhaust stack in proximity to the air moving means for causing a pressure differential whereby a pressure signal may be generated representative of the flow rate of the exhaust stack gases at the orifice.

It is further known to determine the operation of the air moving means as by use of a centrifugal switch or the like. It is also known to provide controls for preventing delivery of fuel to the combustion chamber until such time as the exhaust fan generates sufficient suction pressure to assure proper operation of the furnace.

It is further conventional to provide a reverse flow check valve in the exhaust flue, or vent, so as to prevent passage of downdrafts to the furnace.

SUMMARY OF THE INVENTION

The present invention comprehends an improved power vent and control for use in combustion heating apparatus, such as a furnace or the like.

The invention comprehends the provision of a restricted flow passage in association with a power vent blower. The restricted flow passage may comprise a reduced size outlet flue and an orifice plate arranged to restrict natural thermal convective updraft through the flue but yet permit adequate removal of the products of combustion when the vent blower is operative. Any one of a plurality of orifice plates, each having a different size orifice therein, may be used with a given size furnace to thereby determine the amount of heat exchange while utilizing a single size motor-driven power vent blower.

In a first embodiment, the control is responsive to a pressure condition existing downstream of the power vent blower. In this embodiment, the control may include sensing means for sensing the pressure condition at an orifice provided downstream of the vent blower. The sensing means may further include means for sensing the static air pressure upstream of the orifice.

In a second embodiment, the invention utilizes means for sensing the speed of the air moving means. In this embodiment, the speed is sensed by a magnetic pickup device which illustratively senses the rotation of the blower vanes.

To provide improved speed sensing control, the blower motor is preferably one which increases in speed substantially in the unloaded condition. In the illustrated embodiment, the blower motor comprises a shaded pole motor providing such desired functioning.

To further enhance the speed control functioning, the blower illustratively comprises a blower which unloads under high discharge pressure conditions, such as when the flue is blocked. In the illustrated embodiment, a centrifugal blower is utilized to provide this desirable functioning.

The control may be made responsive to either underspeed or overspeed conditions so as to protect the system against a wide range of malfunctioning conditions.

The control provides a fail-safe functioning by shutting down the fuel supply under the different conditions.

In another embodiment of the invention, flow control means are provided for controlledly obstructing fluid flow through the orifice. More specifically, in this embodiment the flow controlling means includes a gravity-biased closure selectively extending across the orifice to close the orifice when the fluid moving means is not in operation. The closure is movably mounted so as to move away from the orifice as a result of fluid flow induced through the orifice upon initiation of operation of the fluid moving means.

The flow control means is arranged to cause an increased rate of rise of the pressure sensed by the pressure sensor upstream of the orifice so as to provide an improved sensing operation.

The pressure sensing means further serves to detect a lack of proper air flow such as in the event the closure fails to open the orifice.

In the illustrated embodiment, a flow sensing element is disposed in the orifice. More specifically, in the illustrated embodiment, the flow sensor extends upwardly through the orifice and the closure plate is provided with a recess portion receiving the flow sensor when the closure plate is in the closed position across the orifice.

Thus, the flow sensing means is disposed effectively at the position where highest fluid flow velocity is obtained, while yet the apparatus is arranged to effectively close the orifice in the nonoperating condition of the apparatus.

The invention comprehends that the closure be selectively operated by positive means, such as an electrically operated solenoid or the like. Further, while the invention is disclosed utilizing a flow sensing means at the orifice, the invention further comprehends the provision of pressure sensing means at opposite sides of the orifice for use in controlling the operation of the apparatus, such as by means of a control utilizing a single pressure responsive diaphragm.

The power vent and control of the present invention are extremely simple and economical of construction while yet providing the highly desirable features discussed above.

BRIEF DESCRIPTION OF THE DRAWINGS

Other features and advantages of the invention will be apparent from the following description taken in connection with the accompanying drawings wherein:

FIG. 1 is a fragmentary perspective view of a furnace having a power vent system embodying the invention;

FIG. 2 is a schematic diagram of the furnace;

FIG. 3 is a fragmentary elevation illustrating in greater detail the arrangement of the pressure sensing means;

FIG. 3*a* is a fragmentary enlarged horizontal section taken substantially along the line 3*a*—3*a* of FIG. 3;

FIG. 7 is a fragmentary elevation illustrating another form of power vent system embodying the invention and showing in detail the arrangement of the pressure and fluid flow sensing means thereof;

FIG. 8 is a fragmentary enlarged vertical section showing in greater detail the orifice closing means thereof;

FIG. 9 is an enlarged transverse section taken substantially along the line 9—9 of FIG. 7; and FIG. 10 is a graph illustrating the improved rapid rise of the pressure sensed by the pressure sensing means of the embodiment of FIG. 7.

DESCRIPTION OF THE PREFERRED EMBODIMENTS

Figure 4:
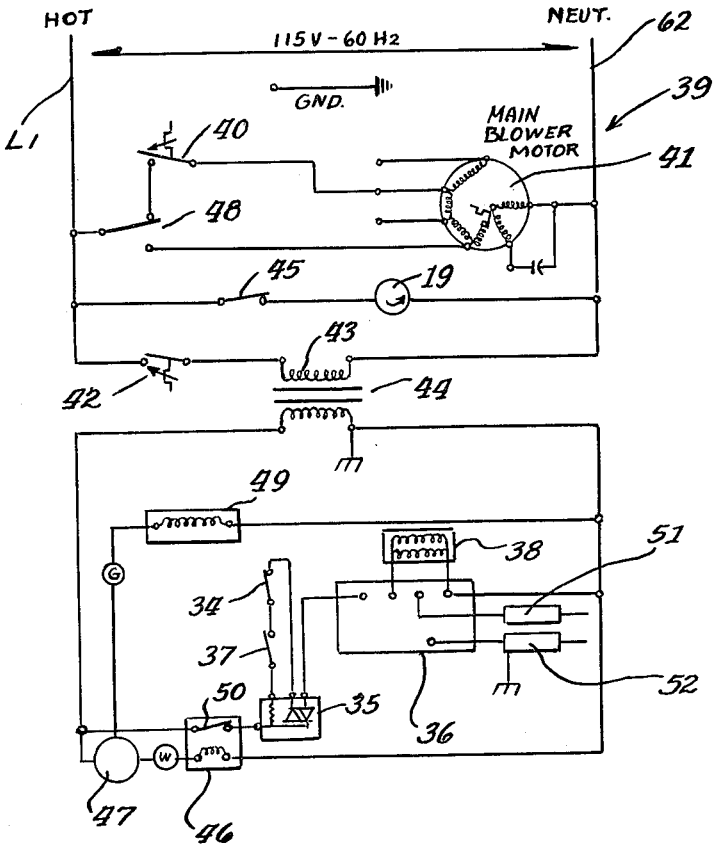
FIG. 4 is a schematic wiring diagram of the control circuitry of the embodiment of FIGS. 1–3.

In the exemplary embodiments of the invention as disclosed herein, a combustion device 10 illustratively comprises a furnace having a burner 11 for providing in a combustion chamber 12 a flame 13. The products of combustion are passed through a heat exchanger 14 to a manifold 15. The manifold is positively exhausted by power vent means 16 to an outlet flue 30 which is typically connected to a flue pipe 17. The power vent means may include a blower 18 driven by a motor 19. Fuel is delivered to burner 11 through a control valve 20. A primary air mover assembly 21 causes the primary air to flow in heat exchange relationship with the heat exchanger 14, thereby heating the primary air.

In the illustrated furnace of FIG. 1, the furnace includes an outer cabinet 22 defining a blower compartment 23 and a discharge plenum 24 for the primary air. Mounted within a control space 25 at the front of the furnace are control elements, such as a conventional gas valve 20, a restrictor 26 defining an inlet for secondary air, a fan limit control 27, and a pre-purge time delay and post-purge control 28.

As indicated above, the invention comprehends an improved power vent means and improved means for controlling its operation. Specifically, as shown in FIGS. 3 and 3*a*, an orifice plate 29 may be provided in a tubular connector 30 connecting the blower 18 to the flue pipe 17. The orifice plate defines an orifice 31. The present invention comprehends that the orifice plate 29 may be any one of a plurality of orifice plates having different size orifices corresponding to different air flow rates desired for different size furnaces, while permitting the use of a single size air moving means 16. The use of blower 18 also permits the diameter of the furnace outlet flue 30 and associated flue pipe 17 to be reduced. More specifically, the size of the orifice provides a predetermined load on the air moving means 16 which, in turn, determines the flow rate for the air moving means 16 and, thus, the furnace heating capacity. By way of example, for a domestic gas furnace having a three-inch diameter flue and using a Torin No. FE-416-108-1 centrifugal blower serving as the vent blower, the heating capacity and corresponding orifice size may be related as follows:

| Furnace Capacity | Orifice Diameter |
|---|---|
| 125,000 BTUH | 1⅝" |
| 105,000 BTUH | 1½" |
| 80,000 BTUH | 1 5/16" |

It is desirable in practicing the present invention to restrict natural convective thermal updraft as much as possible during off cycles, and the use of the power vent blower allows the flow path for the combustion products to be restricted to such an extent that during operation of the burner, adequate removal of the products of combustion will not take place by such natural convective flow.

As illustrated in FIGS. 3, 3*a* and 4, means are provided for determining the pressure conditions within the outlet flue 30 and, by way of example, include a Pitot tube pressure sensor 32 in the orifice 31 and a static pressure sensor 33 within the outlet flue 30 upstream of the orifice.

The Pitot tube sensor 32 senses the negative pressure created by the orifice as a result of the normal air flow from blower 18 therethrough. In the event of blockage of the flue pipe 17, the air flow is decreased and the decrease is sensed by the sensor 32 to open a single pole, normally closed blockage switch 34 connected in series with a triac 35 for controlling a conventional direct spark ignition control 36. In series with the blockage switch 34 is a normally closed air pressure switch 37 controlled by the static pressure sensor 33. Pressure switch 37 senses the pressure caused by the flow of sufficient air to provide for proper combustion in the furnace.

The solenoid coils 38 for controlling the gas valve 20 are connected to the control 36, as shown in FIG. 4, so as to be controlled by the operation of switches 34 and 37.

As shown in FIG. 4, furnace control 39 may be energized from power supply leads L1 and L2. The control includes a fan control 40 connected in series with the main blower motor 41 of primary air mover 21. A limit control switch 42 is connected in series with the primary winding 43 of a control transformer 44 across the power supply leads L1 and L2. Switches 40 and 42 comprise thermostatic switches sensing the temperature of the air heated by the heat exchanger 14. Switch 40 closes to energize motor 41 of main blower 21 when the sensed temperature is approximately 120° F. and opens to discontinue operation of the motor 41 when the temperature drops below 90° F.

Operation of the power vent blower motor 19 is controlled by contacts 45 of a relay 46 in series with a main thermostat 47 of the heating system.

A single pole, double throw contact 48 is operated by a relay 49 which is controlled by a switch in thermostat 47, which may be set by the user to select continuous or automatic operation of the main blower 21.

As shown, relay 46 includes normally open contacts 50 which are in series with the spark ignition module 36 to provide power thereto under the control of thermostat 47.

As further shown in FIG. 4, the spark ignition module 36 receives an input from a flame conductivity sensor 51 and operates a spark igniter 52 and the fuel supply valve coil 38.

In normal operation, thermostat 47 energizes relay 46 to call for heating output of the furnace. This closes the contacts 50 to energize the spark igniter control 36 so as to initiate a heating operation by delivery of fuel to the burner 11 under control of valve 20. When the air temperature sensed by switch 40 reaches the selected temperature, switch 40 closes, thereby energizing the main blower motor 41 and commencing delivery of heated air from the furnace.

At the same time relay 46 closes contacts 50, it closes contacts 45 to energize the power vent motor 19. The normal flow of secondary air and the combustion products through orifice 31 is sensed by the sensor 32, maintaining switch 34 closed. However, if a restriction occurs in the flue pipe 17, the negative pressure on sensor 32 decreases (toward zero) and may go positive, so as to open the contacts 34 to de-energize the triac 35 and correspondingly de-energize the ignition control 36 to close valve 20 and thereby prevent further delivery of fuel to the combustion chamber.

If for any reason during the operation of the furnace the pressure sensed by static pressure sensor 33 drops below a preselected value, switch 37 is caused to open, thus similarly de-energizing triac 35 and the ignition control 36 to de-energize coil 38 and thereby close fuel valve 20 and shut down the furnace.

The power vent means 16 provides a negative pressure within the combustion chamber 12 sufficient to overcome variations in the natural draft. The power vent provides improved efficiency in the operation of a furnace by reducing the amount of excess air required in the combustion process, thereby allowing a more optimum air/fuel ratio to be achieved. In addition, the restricted flow passage provided by the power vent blower 18, the orifice 31 and the reduced diameter of flue 30 reduces convective off cycle heat loss through the system. The thermal efficiency of conventional, natural draft furnaces is limited to approximately 75 percent. The use of the power vent described herein provides a highly desirable increase in the efficiency, and efficiencies of 85 percent are easily obtained. By means of the improved control provided by switches 34 and 37, a safe, highly efficient operation of the furnace is obtained.

It will be appreciated by those skilled in the art that the flow path for the combustion products can be restricted in various alternative ways to produce the desired reduction in off cycle losses while yet permitting adequate removal of the combustion products during periods when the vent blower 18 is operating.

Figure 5:
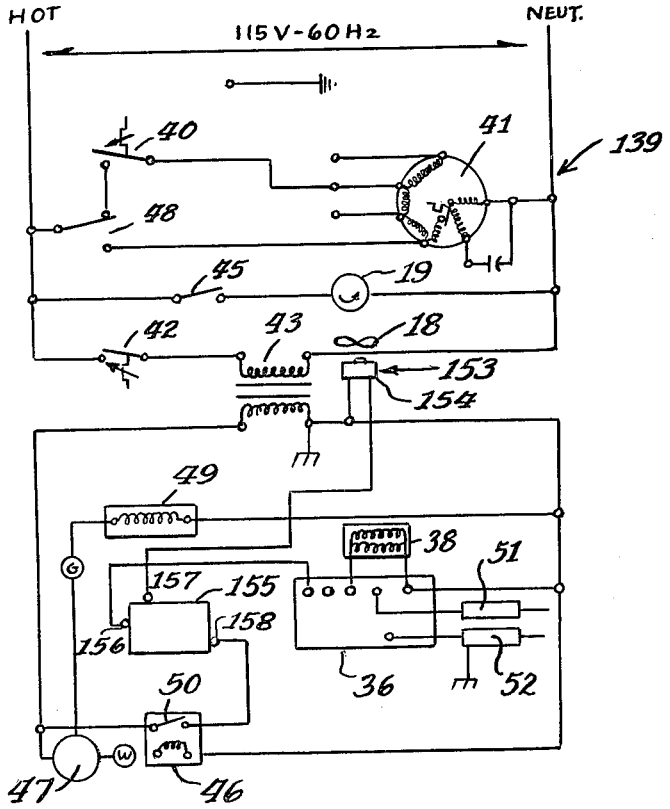
FIG. 5 is a schematic wiring diagram showing a modified form of control utilizing a magnetic sensor for sensing the speed of the air moving means.
Figure 6:
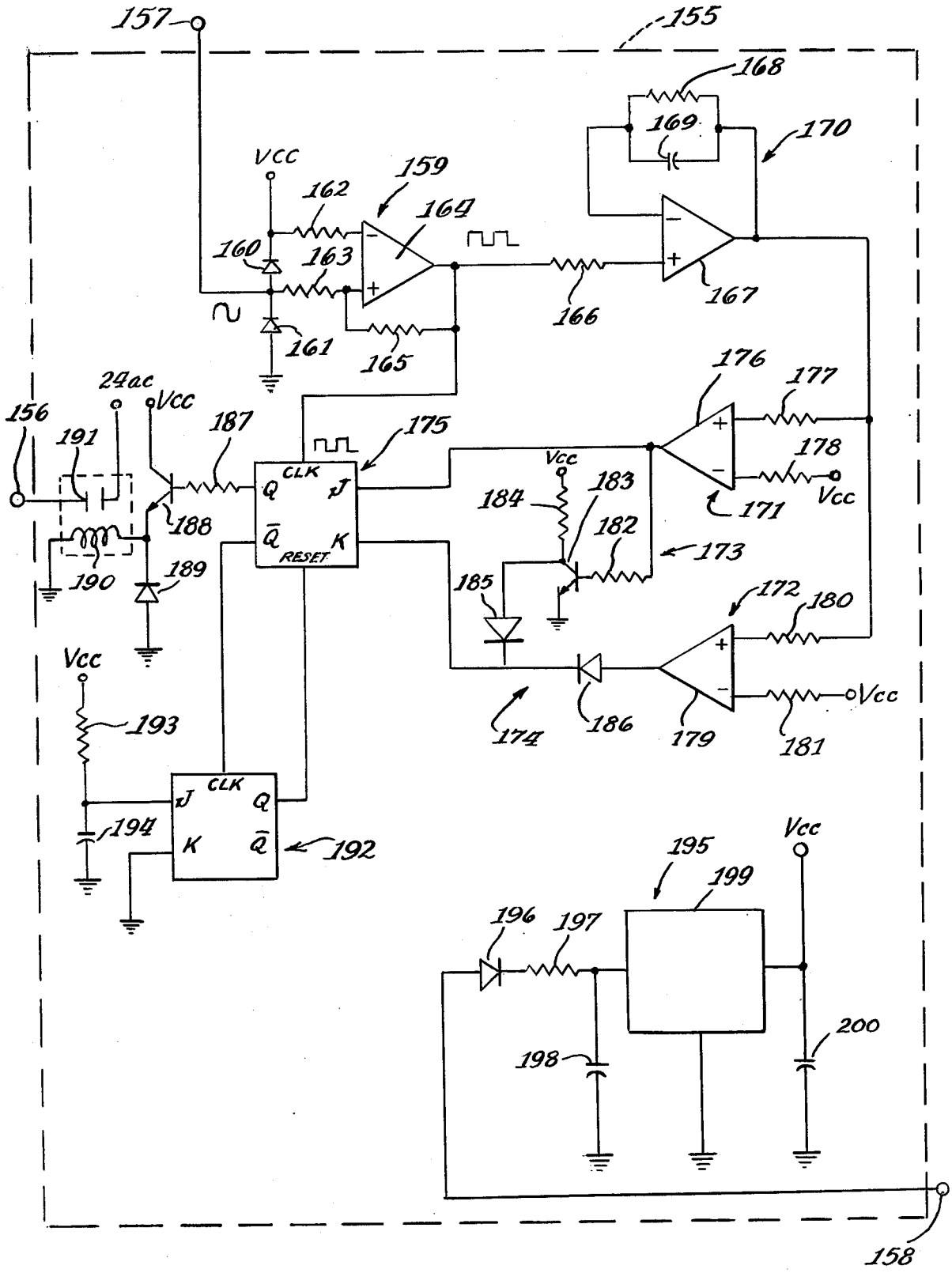
FIG. 6 is a schematic wiring diagram of the control device for providing a control signal from the magnetic pickup means of the control of FIG. 5.

Referring now to the embodiment of FIGS. 5 and 6, a modified form of control generally designated 139 is shown to comprise a control generally similar to control 39, but utilizing a modified means for determining the operating condition of the power vent means. More specifically, as shown in FIG. 5, modified control 139 utilizes a speed sensor generally designated 153 for determining if the blower 18 or, alternatively, motor 19, is operating within a desired speed range. In one illustrative form, as shown in FIG. 5, the speed sensor comprises a magnetic pickup 154 arranged to count revolutions of the blower 18. Sensor 154 is connected to a control 155 which converts the sine wave output of sensor 154 to a suitable signal for controlling the spark ignition module 36. As mentioned above, a blockage in the flue causes the blower 18 to unload as a result of the high discharge pressure encountered. A centrifugal blower is preferably employed for this purpose. Further, motor 19 is preferably a motor whose speed increases appreciably when it is unloaded and, illustratively, motor 19 may comprise a Torin No. 60054 shaded pole motor. In one set of illustrative parameters, the speed of the motor under normal load is approximately 2600 RPM, with the unloaded speed being approximately 3200 RPM.

Referring now to FIG. 6, control 155 has an output 156 connected to the spark igniter control 36, an input 157 connected to the magnetic sensor 154, and an input 158 connected to switch 50 of relay 46. As shown, circuit 155 includes a Schmitt trigger generally designated 159 for shaping the input sine wave. As shown, the trigger includes a pair of diodes 160 and 161 connected through resistors 162 and 163 to the inverting and non-inverting input of an operational amplifier 164, having a resistor 165 connected between the non-inverting input and the output thereof.

As shown, the square wave output of the Schmitt trigger is delivered through a resistor 166 to the noninverting input of an operational amplifier 167 used as a tachometer, generally designated 179. An averaging network including a resistor 168 and a capacitor 169 is connected between the non-inverting input and output of the operational amplifier 167. The output of the tachometer 170 is delivered to a pair of level detectors 171 and 172 whose outputs are combined through an inverter 173 and OR gate 174 and supplied to the K terminal of a JK flip-flop 175. As shown, level detector 171 comprises an operational amplifier 176 having its noninvering input connected through a resistor 177 to the output of operational amplifier 167, and its inverting input connected through a resistor 178 to the power supply. Level detector 172 comprises an operational amplifier 179 having its noninverting input connected through a resistor 180 to the output of operational amplifier 167, and its inverting input connected through a resistor 181 to the power supply.

The output of operational amplifier 176 is connected to a resistor 182 of inverter 173, which resistor in turn connected to the base of a transistor 182 having its collector connected to the power supply through a resistor 184 and its emitter connected to ground. The collector is also connected through a diode 185 to the K terminal of the JK flip-flop 175. The output of operational amplifier 179 is connected through a diode 186 to the K terminal of flip-flop 175 also.

The square wave output of Schmitt trigger 159 is further delivered to the clock contact of the JK flip-flop 175, which is in turn connected to a relay driver circuit 187, comprising a transistor 188 having its collector connected to the power supply, its base connected through resistor 200 to the Q output of flip-flop 175, and its emitter connected through a diode 189 to ground. The emitter is further connected to a relay coil 190 for controlling a normally open contact 191 connected between the power supply and terminal 156 which, as discussed above, is connected to the spark igniter 36.

Control 155 further includes a second JK flip-flop 192 having its clock terminal connected to the $\overline{Q}$ output of the flip-flop 175 and its Q terminal connected to the reset terminal of flip-flop 175. The J terminal of flip-flop 192 is connected through a resistor 193 to the power supply and through a capacitor 194 to ground. The K terminal of flip-flop 192 is connected to ground.

The power supply 195 is connected to the terminal 158 of control 155, from which it receives low voltage AC whenever switch 50 is closed and power is supplied to control transformer 44. As shown in FIG. 6, the power supply includes a diode 196 and a resistor 197 connected in series between terminal 158 and a 15-volt LC regulator 199. A capacitor 198 is connected from resistor 197 to ground. The output of the regulator, in turn, is connected to the power supply terminal Vcc and through a capacitor 200 to ground. The connections between the Vcc terminal of regulator 199 and the Vcc terminals illustrated in connection with the other portions of the control circuit are omitted for simplification of the schematic wiring diagram.

The operation of control 155 in controlling the spark igniter 36 is based on the control of contacts 191 as a function of the frequency of the signal delivered to Schmitt trigger 159 from the speed sensor 153 connected to control terminal 157. In the operation of the control, flip-flop 175 changes from a low to a high state when a 1 is present at the J input and a clock pulse from the Schmitt trigger is received at the clock input. The presence of a 1 at the K input of flip-flop 175 causes the flip-flop to reset so as to have a low output upon receipt of a clock pulse.

When the output of flip-flop 175 goes high, relay coil 190 is energized so as to close contacts 191 and thereby provide power to the spark ignition module 36 through output terminal 156.

Flip-flop 192 serves as a latch for flip-flop 175, holding flip-flop 175 in the "off" state whenever it has been shut down due to the presence of a failure signal delivered from sensor 153 to the input terminal 157 of control 155.

The J and K inputs of flip-flop 175 are controlled by the level detectors 171 and 172. The detectors are biased so that a 1 is produced by detector 171 whenever the speed sensed by sensor 153 is above a predetermined desired minimum, such as 2600 RPM, and level detector 172 produces a 1 at its output whenever the sensed speed is above a predetermined maximum, such as 3200 RPM.

Under normal operating conditions wherein the speed of the blower is within the desired range of 2600 RPM to 3200 RPM, level detector 171 is effective to provide a 1 at the J input of flip-flop 175. The clock pulse received from Schmitt trigger 159 thus immediately clocks the flip-flop into an "on" condition wherein the Q output goes high, thereby energizing the relay coil 190 as discussed above.

In the event the sensed speed drops below the preselected minimum, such as 2600 RPM, the output of level detector 171 drops to zero, and the inverter circuit 173 causes a 1 to appear at the K input to flip-flop 175 so that upon receipt of the next clock pulse, flip-flop 175 resets, thereby deenergizing the relay coil 190.

In the alternative event that the sensed speed rises above the preselected maximum, such as 3200 RPM, each of the level detectors 171 and 172 provides a 1 output. The 1 output of level detector 172 will be supplied to the K input of flip-flop 175 through operation of the OR gate formed by diodes 185 and 186, notwithstanding the 1 output from level detector 171. Under this condition, on the next clock pulse the flip-flop 175 will be reset to de-energize relay coil 190 under this high-speed blower condition.

The averaging network 168,169 associated with tachometer 170 provides a DC level signal which is proportional to the fan speed, which signal is delivered to the noninverting input of the level detector amplifiers 176 and 179.

It will be appreciated that control 155 provides safety protection of the furnace under a number of different failure conditions, such as undervoltage, overvoltage, blower failure, and vent blockage. The control permits the use of the highly desirable power vent in providing improved fuel efficiency in the operation of the furnace and decreased off cycle losses.

Since the ignition control 36 requires energization of coil 190 for its operation, a fail-safe function is provided in connection with any of the above-discussed system failures, as well as any failure of the control circuitry 155.

Referring now to the embodiment of FIGS. 7–10, a further improved modification of the combustion apparatus is shown to comprise a combustion apparatus generally designated 210 similar to apparatus 10 but further including an improved flow control means generally designated 296 for selectively restricting the flow through the orifice 231 defined by the orifice plate 229. Flow control means 296 effectively define means for providing an initial increased rate of rise of the static pressure upstream of the orifice 231 each time the blower 218 is energized. More specifically, as illustrated in FIG. 10, flow control means 296 causes the static pressure sensed by sensor 233 to increase more rapidly upon initial energization of the blower 218 than the rate of static pressure increase associated with the operation of apparatus 10, as illustrated in FIG. 3. This effect is very brief and is a result of the orifice 231 being initially closed by the flow control means 296 when blower 218 is first energized. The resulting increased rate of pressure build-up provides a more positive operation of the switch (not shown) associated with the static pressure sensor 233, and this is highly advantageous because the pressure differential to which the switch must respond is relatively small, as illustrated.

The combustion apparatus 210 permits flow sensor 232 to be disposed such that it extends through the orifice 231, as illustrated in FIG. 8. Thus, the flow sensor is disposed at a location in the system where effectively maximum flue gas velocity exists. Accordingly, the flow sensor 232 is exposed to the largest negative pressure during normal operation of the apparatus.

As illustrated in FIGS. 8 and 9, the flow control means 296 comprises a closure plate or damper 297 having a mounting portion 298 pivotally mounted to the orifice plate 229 by a suitable pivot means 299. In the closed position, closure plate 297 facially engages the upper surface of orifice plate 229. The midportion of the closure plate defines an upwardly projecting boss 300 defining a space 301 opening toward orifice 231 and receiving the end of the flow sensor 232, as shown in FIG. 8.

The closure plate is gravity-biased by its weight so as to close the orifice 231 in the absence of blower-induced air flow upwardly through orifice 231. Upon initiation of the blower 218, air flow upwardly through orifice 231 causes the closure plate to swing from the full line position of FIG. 8 to the dotted line position, while causing the above-discussed rapid static pressure rise upstream of the orifice plate adjacent the sensor 233.

Should the closure plate 297 fail to move from the closed position, the flow sensor 232 immediately detects the failure of air flow through the orifice, thereby permitting the control to de-energize the furnace in accordance with the control operation described above relative to the previously described embodiments. Thus, the flow sensor operates to sense the position of the closure plate and need for an additional sensing device to determine the position of the closure plate is obviated.

While the illustrated embodiment discloses a gravity-biased closure plate, as will be obvious to those skilled in the art, other forms of closure plate control means may be utilized, including electrically operated solenoids and the like, within the scope of the invention.

Further, while the invention has been disclosed utilizing a static pressure sensor 233 in combination with a flow sensor 232, as will be obvious to those skilled in the art, the control may utilize a pair of pressure sensors on opposite sides of the orifice and include a single pressure responsive diaphragm control connected to sense the pressure differential.

The use of the closure plate further improves the operating efficiency of the combustion apparatus by preventing convective flow through the flue when the apparatus is inoperative. It has been found that an improvement in operating efficiency in the range of approximately 3% is thusly obtained.

As in the previous embodiments, the flue pipe 217 and the outlet flue 230 may have a cross section which is smaller in area than that necessary in the absence of a powered blower to effectively vent the combustion chamber for suitable operation of the furnace. The control means of the previously described embodiments may, therefore, be utilized with the apparatus 210. Thus, the control means may include means for sensing the speed of the blower coupled to the control to prevent energization of the blower whenever the speed sensed falls outside a predetermined desired range. The blower may include a drive motor having load speed characteristics such that the motor speed increases substantially when unloaded and the sensing means comprises means for sensing the speed of the motor. Further, the apparatus 210 may be arranged for preventing combustion in the combustion chamber until the air moving means reaches at least a preselected minimum speed.

Still further, the orifice means of apparatus 210 may comprise means for mounting across the vent any one of a plurality of orifice plates each having an orifice therein, with the orifices of the respective plates differing in size for providing selectively different flow rates therethrough.

The apparatus 210 may utilize a speed sensing means comprising a magnetic pickup means responsive to rotation of a rotated metal portion of the air moving means.

The control illustratively may include means responsive to the speed sensing means for preventing delivery of fuel by the delivery means whenever the sensed speed of the air moving means is above a first predetermined speed or below a second lower predetermined speed.

The foregoing disclosure of specific embodiments is illustrative of the broad inventive concepts comprehended by the invention.

Having described the invention, the embodiments of the invention in which an exclusive property or privilege is claimed are defined as follows:

1. In a heating apparatus having means defining a combustion chamber, means for effecting combustion of fuel in said chamber, a vent for discharging products of combustion from said apparatus, blower means connected to said vent for forcibly flowing the products of combustion outwardly through said vent, and means defining an orifice in said vent, the improvement comprising:

means for sensing the static pressure upstream of and adjacent said orifice means;

means responsive to the rate of flow of products of combustion through said vent and the pressure at the orifice for selectively restricting flow through said orifice for providing an increased rate of rise of the static pressure at said pressure sensing means upon initiation of operation of said blower means; and control means for preventing operation of said combustion means in the event said pressure sensing means fails to sense a preselected pressure condition.

2. In a heating apparatus having means defining a combustion chamber, means for effecting combustion of fuel in said chamber, a vent for discharging products of combustion from said apparatus, blower means connected to said vent for forcibly flowing the products of combustion outwardly through said vent, and means defining an orifice in said vent, the improvement comprising:

means for sensing the static pressure upstream of and adjacent said orifice means;

means for sensing flow through said orifice;

means responsive to the rate of flow of products of combustion through said vent and the pressure at the orifice for selectively restricting flow through said orifice for providing an increased rate of rise of the static pressure at said pressure sensing means upon initiation of operation of said blower means; and control means for preventing operation of said combustion means in the event (a) said pressure sensing means fails to sense a preselected pressure condition, or (b) said flow sensing means fails to sense a preselected flow condition.

3. The heating apparatus of claims 1 or 2 wherein said means for selectively restricting flow comprises means for restricting flow through said orifice when the blower means is not operating.

4. The heating apparatus of claims 1 or 2 wherein said means for selectively restricting flow comprises means for closing said orifice when the blower means is not operating.

5. In a heating apparatus having means defining a combustion chamber, means for effecting combustion of fuel in said chamber, a vent for discharging products of combustion from said apparatus, blower means connected to said vent for forcibly flowing the products of combustion outwardly through said vent, and means defining an orifice in said vent, the improvement comprising:

means for sensing the static pressure upstream of and adjacent said orifice means;

flow control means for selectively restricting flow through said orifice for providing an increased rate of rise of the static pressure at said pressure sensing means upon initiation of operation of said blower means; and control means for preventing operation of said combustion means in the event said pressure sensing means fails to sense a preselected pressure condition, said orifice defining means comprising a plate extending transversely across said flue, and said flow control means comprising a pivotal closure element mounted on said plate and gravity biased toward an orifice-closing position.

6. The heating apparatus of claim 2 wherein said flow sensing means extends through said orifice.

7. In a heating apparatus having means defining a combustion chamber, means for effecting combustion of fuel in said chamber, a vent for discharging products of combustion from said apparatus, blower means connected to said vent for forcibly flowing the products of combustion outwardly through said vent, and means defining an orifice in said vent, the improvement comprising:

means for sensing the static pressure upstream of and adjacent said orifice means;

means for sensing flow through said orifice;

flow control means for selectively restricting flow through said orifice for providing an increased rate of rise of the static pressure at said pressure sensing means upon initiation of operation of said blower means; and control means for preventing operation of said combustion means in the event (a) said pressure sensing means fails to sense a preselected pressure condition, or (b) said flow sensing means fails to sense a preselected flow condition, said flow control means being disposed downstream of said orifice and defining a recess space opening toward said orifice, said flow sensing means being disposed in said space.

8. In a heating apparatus having means defining a combustion chamber, means for effecting combustion of fuel in said chamber, a vent for discharging products of combustion from said apparatus, blower means connected to said vent for forcibly flowing the products of combustion outwardly through said vent, and means defining an orifice in said vent, the improvement comprising:

means for sensing the static pressure upstream of and adjacent said orifice means;

means for sensing flow through said orifice;

flow control means for selectively restricting flow through said orifice for providing an increased rate of rise of the static pressure at said pressure sensing means upon initiation of operation of said blower means; and control means for preventing operation of said combustion means in the event (a) said pressure sensing means fails to sense a preselected pressure condition, or (b) said flow sensing means fails to sense a preselected flow condition, said flow control means comprising a gravity-biased closure plate disposed downstream of said orifice and defining a recess space opening toward said orifice, said flow sensing means being disposed in said space.

9. In a heating apparatus such as a domestic furnace having means defining a combustion chamber, delivery means for delivering combustible fuel to said chamber for combustion therein, and an outlet flue for discharging the products of combustion from said apparatus, the improvement comprising:

blower means connected to said outlet flue for forcibly causing the products of combustion to flow therethrough;

means defining a flow restricting orifice disposed within said outlet flue and defining a restricted flow passage having a size determined in accordance with the desired firing rate of said heating apparatus;

a normally closed damper overlying said orifice and arranged to open in response to blower induced flow through said orifice;

flow sensing means disposed at said orifice and adjacent said damper for sensing the flow through said restricted passage; and, control means responsive to said flow sensing means for preventing operation of said fuel delivery means when said sensing means indicates less than a preselected flow through said passage.

10. The heating apparatus of claim 9 wherein said flow sensing means comprises a pressure sensing means disposed within said restricted flow path defined by said orifice.

11. The heating apparatus of claim 9 wherein said damper is disposed downstream of said orifice and is gravity biased to close said orifice.

12. The heating apparatus of claim 9 wherein said flow sensing means provides an output signal only in response to a predetermined flow outward through said restricted flow passage.

13. In a heating apparatus having means defining a combustion chamber, means for effecting combustion of fuel in said chamber, a vent for discharging products of combustion from said apparatus, blower means connected to said vent for forcibly flowing the products of combustion outwardly through said vent, and means defining an orifice in said vent, the improvement comprising:

means for sensing the static pressure upstream of and adjacent said orifice means;

means for sensing flow through said orifice;

flow control means for selectively restricting flow through said orifice for providing an increased rate of rise of the static pressure at said pressure sensing means upon initiation of operation of said blower means; and control means for preventing operation of said combustion means in the event (a) said pressure sensing means fails to sense a preselected pressure condition, or (b) said flow sensing means fails to sense a preselected flow condition, said orifice defining means comprising a plate extending transversely across said flue, and said flow control means comprises a pivotal closure element mounted on said plate and gravity-biased toward an orifice-closing position.

* * * * *